United States Patent [19]

Caisso et al.

[11] Patent Number: 4,752,333

[45] Date of Patent: Jun. 21, 1988

[54] ALLOYS HAVING HIGH ELECTRICAL AND MECHANICAL CHARACTERISTICS, THE PRODUCTION THEREOF AND THE USES THEREOF IN PARTICULAR IN THE ELECTRICAL, ELECTRONIC AND CONNECTION ARTS

[75] Inventors: Jules Caisso; Martine Cahoreau, both of Poitiers; Edmond Dedieu, Saint Julien l'Ars; Michel Grosbras, Poitiers, all of France

[73] Assignee: Trefimetaux, Paris, France

[21] Appl. No.: 13,975

[22] PCT Filed: May 5, 1986

[86] PCT No.: PCT/FR86/00156

§ 371 Date: Jan. 9, 1987

§ 102(e) Date: Jan. 9, 1987

[87] PCT Pub. No.: WO86/06871

PCT Pub. Date: Nov. 20, 1986

[30] Foreign Application Priority Data

May 10, 1985 [FR] France ..... 85 07157

[51] Int. Cl.[4] ..... C22C 29/12

[52] U.S. Cl. ..... 75/232; 419/19; 419/21; 419/23; 419/28; 419/45; 419/58; 419/32

[58] Field of Search ..... 75/232; 419/19, 21, 419/28, 32, 23, 45, 58

[56] References Cited

U.S. PATENT DOCUMENTS

| | | | |
|---|---|---|---|
| 3,893,844 | 7/1975 | Nadkarni | 419/19 |
| 4,077,816 | 3/1978 | Nadkarni | 419/19 |
| 4,274,873 | 6/1981 | Nadkarni | 419/19 |
| 4,315,777 | 2/1982 | Nadkarni et al. | 75/232 |

*Primary Examiner*—Stephen J. Lechert, Jr.

*Attorney, Agent, or Firm*—Dennison, Meserole, Pollack & Scheiner

[57] ABSTRACT

The invention concerns alloys comprising a matrix based on at least one conductor metal M, formed by a homogeneous dispersion in the matrix of stable coherent particles of one or more associations of ions of type M, M', O in which M represents the metal or metals of the matrix, M' represents a different metal from M, which is capable of undergoing internal oxidation, and O represents oxygen.

It also concerns the process for the production of such alloys which comprises subjecting a starting alloy powder to the action of an oxidizing agent formed by a powder with a granulometry of the order of 1 μm of a metal oxide capable by thermal decomposition of providing the oxygen necessary for the internal oxidization of M', the starting alloy being based on at least one metal M, if appropriate hardened by one or more elements R or A as defined hereinbefore.

Use of such alloys for the electrical, electronic and connection arts.

20 Claims, 3 Drawing Sheets

Figure 1:
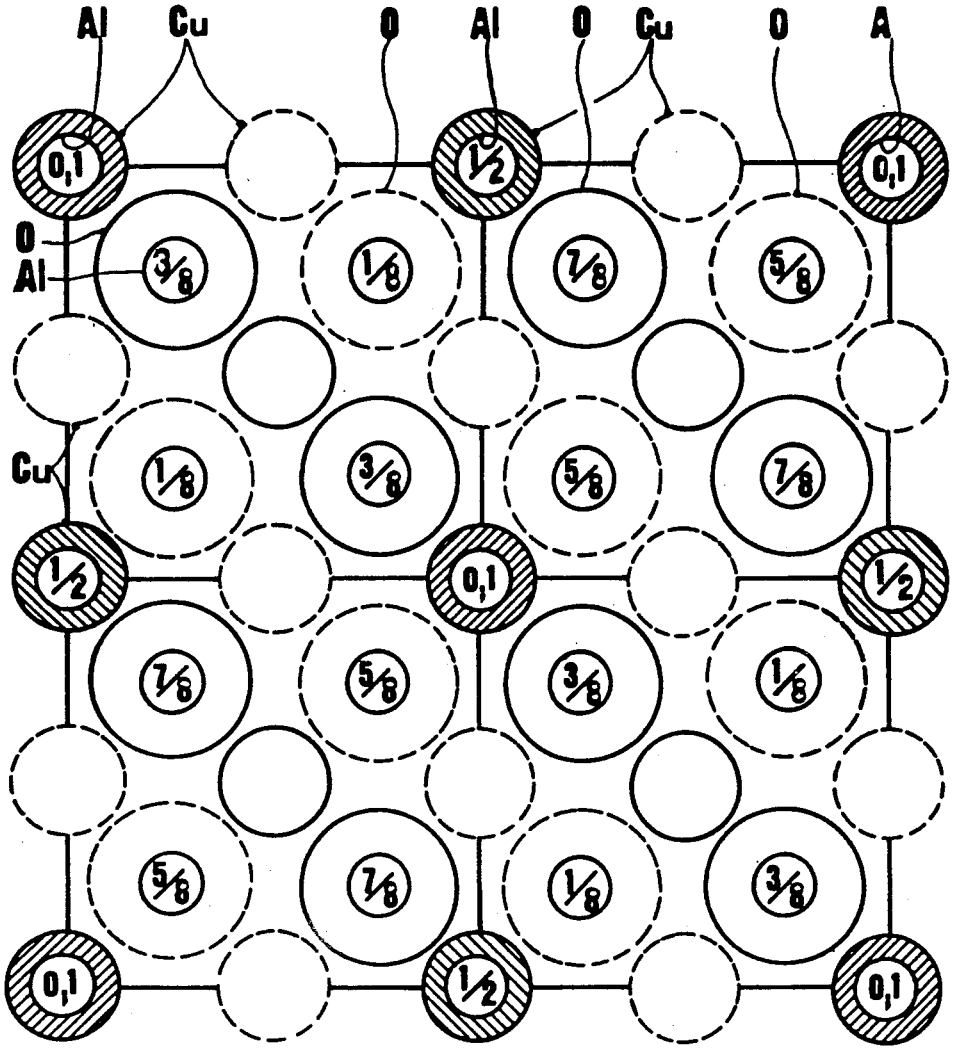

ALLOYS HAVING HIGH ELECTRICAL AND MECHANICAL CHARACTERISTICS, THE PRODUCTION THEREOF AND THE USES THEREOF IN PARTICULAR IN THE ELECTRICAL, ELECTRONIC AND CONNECTION ARTS

The invention relates to novel alloys which have both in particular high electrical and mechanical characteristics, the production thereof and the uses thereof in particular in the electrical, electronic and connection arts.

For a period of around ten years now, the lines of research followed by metallurgists have been directed towards improving the mechanical properties and the temperature resistance of metal alloys. In most cases, use is made of the hardening effect of particles of a second phase.

That phase may be formed by precipitation from a supersaturated solid solution. However, that procedure involves the disadvantage of giving rise to the loss of mechanical properties at high temperature, as a result of total or partial re-dissolution of the precipitates. In another procedure, fine dispersions of hard particles are introduced directly into the metal or are formed by internal oxidation of the metal in a weakly alloyed state, resulting in a high level of hardening which fades away only in the vicinity of the melting point.

Various alloys comprising a matrix based on a conductor metal M hardened by a metal oxide M'O have already been prepared using powder metallurgy technology and in situ oxidation of the metal solute of the initial alloy of the 'metal matrix-metal solute' type.

The preparation of alloys of that type from an alloy powder comprising a metal in the form of a solute in a metal matrix is described in particular in U.S. Pat. No. 3,779,714. The process of that patent comprises using a mixture of oxidising agents for the internal oxidation step. It involves a metal oxide which can be reduced under the effect of heat and a hard refractory metal oxide.

The use of such a mixture under the conditions under which that process is carried into effect results in the formation of an alloy of M and M'O, study of which under an electron microscope reveals particles of oxide of a size which for the major part is greater than 0.1 μm. That therefore essentially involves incoherent particles, that is to say particles which are characterised by non-continuity of the crystallographic planes at the particles-matrix interface and the absence of elastic deformation phenomena in the vicinity of the interface.

The work done by the inventors in this art have led them to find that, by using a given oxidising agent for the internal oxidation operation, and while operating under certain conditions, it is possible to produce only particles of a very small size, which are distributed in a homogeneous fashion and which make it possible to increase the elastic limit of the alloy without substantially affecting the conducting properties thereof.

The invention therefore seeks to provide novel alloys which have both high conducting and mechanical properties.

The invention also seeks to provide a process for the preparation of such alloys by internal oxidation, which is easy to carry into effect.

The invention further seeks to provide materials based on said alloys, which can be used in particular in the electrical, electronic and connection arts, in particular by virtue of their good mechanical strength and their high level of conductivity.

The alloys according to the invention which comprise a matrix based on at least one conductor metal M are characterised in that they are formed by a homogeneous dispersion in the matrix of stable coherent particles of one or more association of ions of type M, M', O in which M represents the metal or metals of the matrix, M' represents a metal different from M, capable of undergoing internal oxidation, and 0 represents oxygen.

The expression 'coherent particles' denotes particles which, unlike the particles referred to as incoherent particles, which are present in alloys of type M M'O prepared in accordance with the prior art, have a continuity in respect of the crystalline planes at the interface between the particle and the metal of the matrix, and substantial deformation in the vicinity of the interface.

In general, the mean size of such particles is less than about 20 nm, in particular of the order of 10 nm.

In accordance with another aspect, those particles are distributed uniformly in the metal matrix M, the interparticular distance being about 60 nm, giving the alloy a high degree of homogeneity.

By virtue of that structure, in the form of coherent particles, the associations in question impart highly attractive properties to the alloys according to the invention.

Indeed, the coherent particles are intimately linked to the metal matrix and, when the metal is cut up, in contrast to incoherent particles, they do not separate from the matrix and they do not give rise to an abrasive action. That results in particulate in a lower amount of wear of the cutting tools.

The materials are also found to have a higher level of resistance to fatique and are better suited to a coating operation, for example gilding, by virtue of the absence of surface roughness which in contrast occurs with the incoherent particles which are to be found in the prior-art alloys.

The experiments carried out have also revealed a good resistance to the erosive action of an electric arc, in comparison with silver-base alloys.

In addition, in an advantageous manner, the coherent particles experience virtually no coalescing when the materials are subjected to annealing which gives the alloys a better resistance to annealing than that of alloys based on incoherent particles.

In a group of preferred alloys according to the invention, the matrix is formed by a single conductor metal M. Advantageously, M represents copper. Another suitable conductor metal is silver.

In another group of alloys, the matrix comprises at least one base metal M forming one or more solid solutions with one or more solutes R.

Preferred solid solutions of that type comprise a matrix based on copper, containing as the solute an element R such as P, Sn or Zn.

Other solid solutions are of the type Ag-Pd.

In another alternative form, the matrix is based on at least one metal M which is hardened by the precipitation of one or more elements A, by a structural hardening phenomenon or by spinodal decomposition (precipitation with orderly arrangement of the atoms of the additive elements).

Advantageously, in that last-mentioned alternative, the matrix is based on copper, being hardened by the precipitation of elements A, such as for example Fe, Fe and P, Ni and Si, Ni and Al, Zr, Cr, Co or Co and Si, in a proportion which may be up to about 1%.

That concerns for example alloys involving structural hardening by means of precipitation such as Cu-Fe, Cu-Fe-P, Cu-Ni-Si, Cu-Ni-Al, Cu-Zr, Cu-Cr, Cu-Co or Cu-Co-Si.

In accordance with one embodiment of the invention, the associations of ions M, M'O which are dispersed in the metal matrix correspond to a single type of association In an alternative embodiment, the alloys of the invention comprise a plurality of types of association M, M'O, the symbols M' then being of different meanings.

The ions M' represent more especially aluminium, thorium, beryllium or titanium ions, with aluminium being preferred.

Alloys comprising coherent particles of associations of ions (Cu, Al, O) which are dispersed in a copper matrix, formed from solid Cu-Al solutions with 0.25 to 0.30% Al by weight approximately make it possible to achieve a good compromise between mechanical and electrical properties.

Alloys of that type, in their crude manufactured state, are characterised by an electrical conductivity of at least 85% IACS, a breaking stress of higher than about 500 MPa and a 0.2% elastic limit of higher than about 450 MPa.

Alloys of particularly high levels of electrical and mechanical performance are prepared using the internal oxidisation process described hereinafter, from a powder containing the base metal M of the matrix, the metal or metals M' being capable of undergoing oxidation and if necessary elements with a hardening effect.

The process according to the invention for the production of the alloys defined hereinbefore is characterised by subjecting the initial alloy powder whose granulometry is compatible with the formation of coherent particles to the action of an oxidising agent formed by a powder of a granulometry of the order of 1 μm of a metal oxide capable by thermal decomposition of providing the oxygen necessary for the internal oxidation of M, the starting alloy comprising a matrix based on at least one metal M, if appropriate hardened by one or more elements R or A, as defined hereinbefore.

Advantageously, the small granulometry on the one hand of the initial alloy and on the other hand of the oxidising agent result in the production of coherent particles of small size, giving the alloy a higher elastic limit than that achieved with the alloys of the prior art.

In accordance with an additional provision, the mixture of the initial alloy powder and the oxidising agent is subjected to at least one densification operation.

The starting powder is more particularly formed by particles of a granulometry of less than 400 μm, more especially of less than about 180 μm, in particular from 30 to 100 μm.

The oxidising agent is preferably formed by a metal oxide in which the metal is identical to the base metal of the matrix, M.

A slight excess of oxidising agent with respect to the amount required to form the stoichiometric oxide M' O is advantageously used.

The oxidising agent and the starting alloy in the form of powders are mixed and subjected to the internal oxidation operation.

The oxidation times and the oxidation temperature will be easily determined by the main skilled in the art on the basis of calibration curves giving the depth of oxidation in dependence on time in the base alloy used.

The residual oxygen is reduced by heating in a hydrogen atmosphere.

In order to facilitate the sintering operation, the material obtained is advantageously subjected to at least one densification operation, for example a pressure compacting step.

Study of the conditions for the production of the composite alloys of type Cu (Cu, Al,O) shows that it is advantageous to use a powder of Cu-Al alloy containing from 0.10 to 1% approximately by weight of aluminium, preferably from 0.25 to 0.30% by weight approximately, thus making it possible to achieve a good compromise between mechanical properties, in particular temperature resistance, and electrical properties. The granulometry of the Cu-Al powder is more especially between 30 and 110 μm.

The oxidising agent is then advantageously formed by $Cu_2O$ in the form of particles of granulometry which does not exceed approximately 1 μm.

Mixing of the Cu-Al with $Cu_2O$ is in a proportion of about 2 to 2.5 parts by weight of $Cu_2O$ for 100 parts by weight of Cu-Al.

For uses in which electrical conductivity is not essential, the amount of Al may advantageously be increased to 1% in order to further enhance mechanical properties, while retaining a level of electrical conductivity of for example between 40 and 60% IACS.

Prior to the internal oxidation step, it appears to be advantageous to carry out a first densification step by compacting under a low pressure in order to allow the oxygen still to have the possibility of diffusing.

Internal oxidation is carried out at a temperature of the order of 900° C. for about 30 to 45 minutes.

The residual copper oxide is annealed in a hydrogen atmosphere at a temperature of the order of 800° C. approximately for a period of at least 2 hours.

In order to make the sintering operation easier, another densification operation is carried out. A pressure of the order of 70 to 80 MPa makes it possible to produce a material with a relative density of close to 0.8.

It will be noted that advantageously all the operations carried out for production of the alloys can be performed in the same container, thus constituting a simplification in relation to the prior art and giving economic advantages.

The granulometries used make it possible to produce solely coherent particles of small size, resulting in an increase in the elastic limit in comparison with the alloys of the type M, M' O containing incoherent particles. Experimental results show that the elastic limit of the materials of the invention is about 7% higher than that of the alloys M, M' O of the prior art.

It is also interesting to note that, in the case of the material produced in that way, which essentially contains only coherent particles, the Young's modulus is that of the copper matrix throughout the crystal whereas, in the materials with incoherent particles, the Young's modulus is different from that of the copper (or M), at the location of the incoherent particles where the modulus is that of $Al_2O_3$ (or M' O).

The tests in respect of deformation at an imposed rate (in the cold condition and after annealing), tests in respect of hardness and measurements in respect of electrical conductivity, of the alloys obtained, revealed their high mechanical properties, their performance after annealing at elevated temperature and equally high electrical properties.

Having regard to those properties, the alloys are particularly suitable for uses in which good mechanical properties are required at the same time as a high level of electrical or thermal conductivity.

In the field of electrical uses for example, they are suitable for the following:

electrical coils, in particular for very strong fields
electrical switching devices
electrodes.

They are also suitable for forming heating exchangers and any component which is subjected to variations in temperature such as discs for disc brakes.

Those alloys are also an attractive proposition in the electronic and connection arts.

The electronic uses primarily involve using them in the form of carriers, for example for transistors, diodes or integrated circuits.

In the case of transistors or diodes, the matrix metal used in the alloys of the invention is very advantageously pure copper OFHC, or copper deoxidised with phosphorus (Cu/b) or alloys of copper with very little filler material.

In the connection art, the alloys of the invention, in particular those in which the matrix forms a solid solution or is hardened by precipitation of an element, are advantageously used for the production of conductor springs, terminals and connectors for the automobile industry, the domestic electrical industry and electronics.

Moreover, in conventional equipment, they permit significant reductions in the sizes of certain copper-base components.

Furthermore, by virtue of their good mechanical strength after being held at elevated temperature, the material retains in particular its strength after operations such as brazing.

Figure 2:
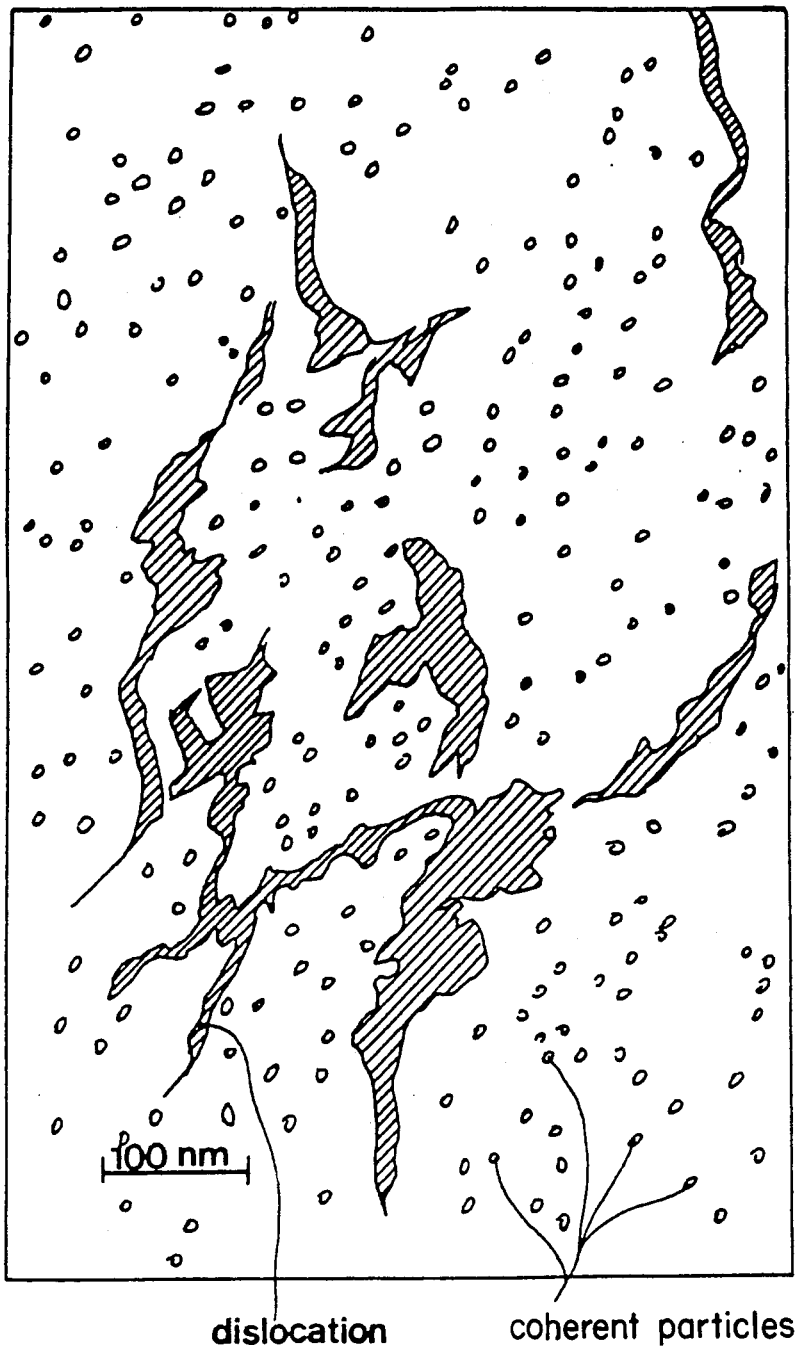
Figure 3:
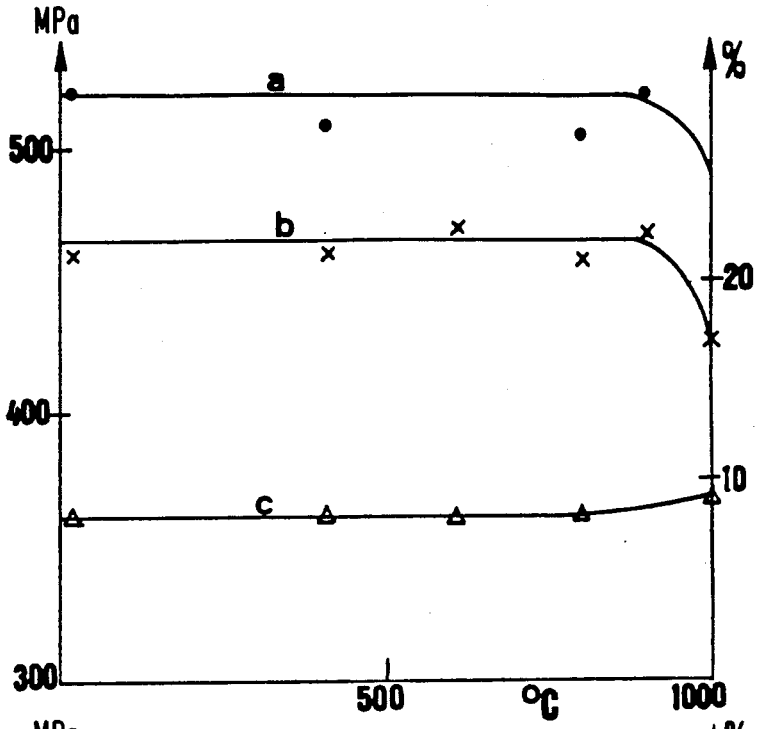
Figure 4:
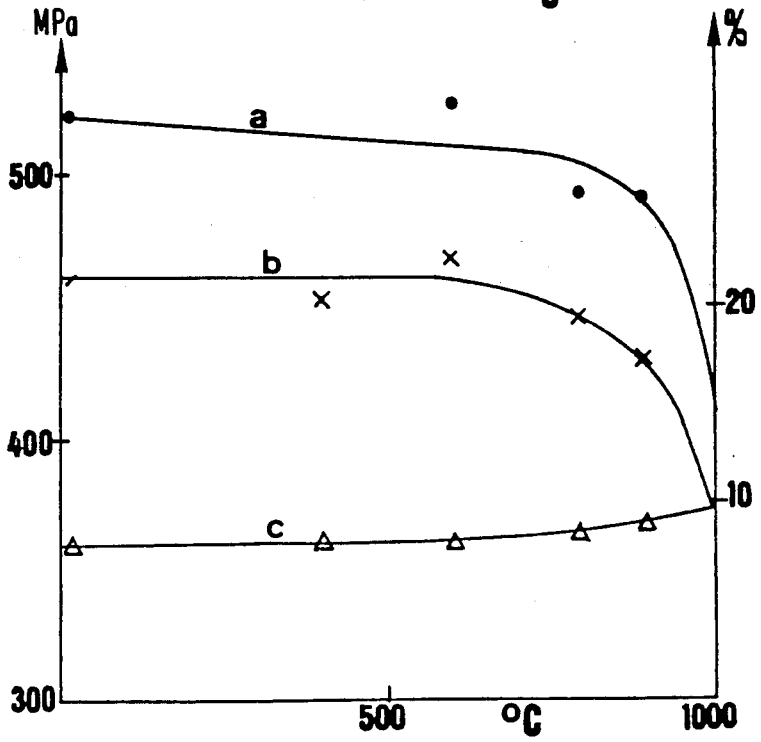

Other characteristics and advantages of the invention will be apparent from the following example relating to the production of an alloy and with reference to the accompanying drawings in which:

FIG. 1 shows the crystalline structure of the coherent particles of alloys of the invention as determined by X-ray, FIG. 2 shows an electron micrograph (magnification of 230,000) of a composite material according to the invention, and FIGS. 3 and 4 show the variations in mechanical characteristics (breaking stress, elastic limit and elongation) after an annealing operation for 2 hours and an annealing operation for 10 hours respectively.

EXAMPLE

Preparation of an alloy of copper and coherent particles (Cu, Al, O).

1. Preparation of a powder of Cu-Al alloy on the one hand and $Cu_2O$ powder on the other hand:

(a) Cu-Al powder:

Commercially available Cu-Al powders are used, such as that marketed by Société des Poudres de Sénécourt (F 60140 LIANCOURT) with an aluminium content by weight of between about 0.15 and 0.30%, of the following granulometries:

44–63 μm
75–108 μm
140–180 μm

Those powders are subjected to a preliminary degassing step (2 hours at 120°C.);

(b) $Cu_2O$ powder:

The $Cu_2O$ powder used is also subjected to a preliminary degassing operation.

2. Mixing of the Cu-Al powder and the oxidising powder.

Using an electrical mixer, 2.37 g of $Cu_2O$ for 100 g of Cu-Al powder is mixed in a copper container.

3. Conditioning of the mixture.

The mixture of the two powders introduced into the copper container is placed on a vibratory table for a first densification operation.

The operation of conditioning the mixture is followed by an operation of compressing the aggregate of powders contained in the container in order to cause it to acquire a sufficient green strength for it to be handled without special precaution. The pressure used is 8 MPa.

4. Internal oxidation

After the copper container has been completely closed, the internal oxidation treatment is carried out. Internal oxidation is performed using the conventional Rhines pack procedure described by Rhines F.N. et al in Trans of A.I.M.E. 1940, 137, page 318.

The sealed copper container containing the mixture of Cu-Al and $Cu_2O$ powders is disposed in an alumina vessel which is placed in a furnace. After a primary vacuum has first been produced in the vessel, a continuous scavenging flow of argon N 55 (containing 99.9995% of argon) is effected throughout the duration of the oxidation operation (rise in temperature, holding time and cooling). The container is cooled in the furnace. At the end of the oxidation operation, the mixture is in the form of an aggregate.

The oxidation time was determined for each granulometry by using the calibration measurements, the results of which are set forth in the following Table:

| Depth of oxidation | Oxidation time | Oxidation temperature | Origin of the time | Method of cooling |
|---|---|---|---|---|
| 0.05 | 4 min 7s | 1000° | Putting in the furnace | Air |
| 0.10 | 7 min | 1000° | Putting in the furnace | Air |
| 0.12 | 9 min | 1000° | Putting in the furnace | Air |
| 0.20 | 10 min | 1000° | Putting in the furnace | Furnace |
| 0.18 | 45 min | 900° | Putting in the furnace | Furnace |
| 0.05 | 20 min | 800° | Putting in the furnace | Air |
| 0.10 | 60 min | 800° | Putting in the furnace | Furnace |

5. Deoxidation of the powder aggregate.

The container is opened at its two ends and the powder aggregate is scavenged by a mixture of hydrogen and nitrogen. The scavenging operation is effected at a temperature of 820° C. after a vacuum has first been produced in the alumina vessel.

After the operation of reducing the residual copper oxide, the powder aggregate is subjected to a compression treatment which is essential in order to achieve a good level of performance on the part of the casing of the container in the final treatment for densification of the powder aggregate.

6. Densification of the powders.

Among the processes which can be used, processes involving sintering at elevated temperature, rolling, sintering and extrusion in the hot condition, and cold drawing were employed.

The process involving sintering and extrusion in the hot condition which is advantageously employed makes it possible simultaneously to effect compression and sintering of the agglomerate of powders produced after internal oxidation.

The arrangement consists of a hydraulic press and furnace which is disposed in the vicinity thereof and which permits heating of the container before extrusion thereof. The hydraulic press used has a capacity of 80 tonnes, its container is heated to 400° C. and the speed of movement of the piston is of the order of a metre per second. Heating of the container in the furnace is effected in the air, for a period of 1 hour. Experiments were carried out in the temperature range 700°C.<t<900° C. (temperature of the metal). Dies of circular or rectangular section, of different dimensions corresponding to extrusion ratios of between 20 and 60, were used. The previously produced cylindrical bar can be subjected to a further drawing treatment.

A plurality of successive passes through dies of decreasing diameters are carried out to subject the material to the desired drawing treatment. The drawing percentage obtained applied to the samples is at least 26%.

Set out below are the results obtained when studying the structure of the alloy and the mechanical characteristics thereof (elastic limit, breaking stress and elongation) and electrical conductivity of the composite material Cu-(Cu-Al-O) produced.

I: Structure of the alloy.

Study of intensities diffused by the crystalline structure showed that the structure of the coherent particles does not correspond to that of the oxide $Al_2O_3$ but to a cubic structure with an arrangement of ions Cu, Al and O.

FIG. 1 shows the structure of the coherent particles determined by X-rays, the size of the different types of ions or atoms being arbitrary. The dimensions in respect of the oxygen and copper are as follows (such values are defined on an axis perpendicular to the plane of the drawing):

Oxygen: (largest circle), solid-line circle $\frac{1}{8}$, $\frac{5}{8}$, broken-line circle $\frac{3}{8}$, $\frac{7}{8}$: copper (medium circles) ◎:178, ◎:0, 1, ◯:$\frac{1}{4}$, $\frac{3}{4}$ and ◯:0, $\frac{1}{2}$, 1. For the aluminium (smallest circle), the vertical dimension is that indicated directly in the drawing.

FIG. 2 corresponds to an electron micrograph (magnification of 230 000) of the material Cu-(Cu-Al-O), with 0.3% by weight of Al. Examination of that photograph shows the coherent particles of (Cu-Al-O) which are visible throughout the grain. By way of indication, some of those particles are marked by means of arrows.

II: Mechanical characteristics.

The head testpieces used for the tensile tests were of the following useful length and diameter respectively:

$l=25$ mm and $\phi=3$ mm.

II. 1 - Crude material as manufactured

| Elastic limit MPa | Breaking stress MPa | Elongation % over 25 mm |
|---|---|---|
| 452 | 512 | 9.8 |

II. 2 - Material after undergoing annealing

The variation in breaking stress and plastic elongation in dependence on the annealing temperature for an annealing time of 2 hours is shown in FIG. 3 (illustrating respectively curves a, b and c in respect of the variation in the imposed stress in MPa or elongation in percent in dependence on the temperature in degrees C).

The same characteristics are set forth in FIG. 4, for an annealing time of 10 hours.

Examination of those curves shows the good characteristics of the material in the initial state and shows that the influence of a prolonged annealing operation has virtually no effect on the mechanical strength of the alloy for a temperature of lower than 900 C.

II. 3 - Material after drawing

After sintering and extrusion in the hot condition, the samples are subjected to cold drawing with a drawing factor of 20%.

The variation in the mechanical properties which are linked to that treatment is set forth in Table I:

| | Elastic limit MPa | Breaking stress MPa | Elongation % over 25 mm |
|---|---|---|---|
| before drawing | 435 | 494 | 9.8 |
| after drawing | 584 | 597 | 6.8 |

III. - Electrical properties

Before measuring electrical conductivity using a four-terminal method the initial bar is subjected to a chemical desheathing operation to remove the surface layer of copper (container), and then a cold drawing operation to make the section thereof uniform. Measured electrical conductivity is 85% IACS.

We claim:

1. Alloys comprising a matrix based on at least one conductor metal M, characterised in that they are formed by a homogenous dispersion in the matrix of stable coherent particles of one or more associations of ions of type M, M', O, in which M represents the metal or metals of the matrix, M' represents a different metal from M, which is capable of undergoing internal oxidation, and O represents oxygen.

2. Alloys according to claim 1 characterised in that the matrix is formed by a metal M which is a conductor of electrical current.

3. Alloys according to claim 1 characterised in that the matrix comprises at least one base metal M forming one or more solid solutions with one or more solutes of type R.

4. Alloys according to claim 1 characterised in that the matrix is based on at least one metal M hardened by precipitation of one or more elements A.

5. Alloys according to claim 1, 2, 3 or 4 characterised in that M represents copper.

6. Alloys according to claim 3 characterised in that M represents silver and contains palladium as the solute R.

7. Alloys according to claim 1, 2, 3 or 4 characterised in that they comprise a single type of associations of ions M, M', O.

8. Alloys according to 1, 2, 3 or 4 characterised in that they comprise a plurality of types of associations of ions M, M', O.

9. Alloys of the type Cu-(Cu-Al-O) characterised in that they comprise coherent particles of associations of ions (Cu-Al-O) which are homogeneously dispersed in a copper matrix.

10. A process for the production of an alloy comprising a matrix based on at least one conductor metal M, having dispersed in said matrix stable coherent particles of one or more associations of ions of the type M, M', O, wherein M' is a different metal from M and is capable of undergoing internal oxidation, and O is oxygen, comprising the steps of: subjecting an initial alloy powder containing M and M' to the action of a metal oxide oxidizing agent formed by a powder having a granulometry on the order of 1 micron which is capable by thermal decomposition of providing oxygen for the internal oxidation of M'.

11. Process according to claim 10, wherein said starting alloy is hardened by one or more solute elements R, and/or one or more precipitation elements A.

12. Alloys according to claim 3, wherein said solute R is selected from the group consisting of P, Sn and Zn.

13. Alloys according to claim 4, wherein said element A is selected from the group consisting of Fe, Fe and P, Ni and Si, Ni and Al, Zr, Cr, Co and Co-Si and the proportion of said element A is up to 1%.

14. A process according to claim 10 characterised by subjecting the mixed powder to a densification operation before carrying out the internal oxidation step.

15. A process according to claim 10 characterised in that the granulometry of the starting alloy powder is less than approximately 180 μm.

16. A process for the production of a composite alloy of the type Cu-(Cu-Al-O) comprising the following steps:

mixing a powder of alloy Cu-Al containing from 0.15 to 1% approximately by weight of aluminum, having a granulometry of the order of 30 to 100 μm, with a powder of $Cu_2O$, with a granulometry not exceeding approximately 1 μm, in a proportion of from 2 to 2.5 parts by weight approximately of $Cu_2O$ for 100 parts by weight of Cu-Al, compacting the mixture under a low pressure, internally oxidizing the compacted mixture in a copper container at a temperature of the order of 900° C. for about 30 to 45 min, reducing the residual copper oxide in the oxidized mixture in a hydrogen atmosphere at about 800° C. for a period of at least 2 hours, compacting of the reduced mixture under a pressure of about 80 MPa, and sintering and then shaping the compacted, reduced mixture by hot extrusion.

17. Process according to claim 15, wherein the granulometry of the alloy powder is about 30 to 100 μm.

18. Process according to claim 16, wherein the alloy Cu-Al contains about 0.25 to 0.30% by weight aluminum.

19. Alloys according to claim 1, wherein said coherent particles are less than about 20 nm in size.

20. Alloys according to claim 1, wherein the distance between said coherent particles is about 60 nm.

* * * * *